United States Patent [19]

Iezza

[11] 4,415,150

[45] Nov. 15, 1983

[54] PORTABLE KNOCK-DOWN PARALLEL BAR EXERCISE FIXTURE

[75] Inventor: Franco S. Iezza, Los Angeles, Calif.

[73] Assignee: J. Daniel Scherling, Montrose, Calif.

[21] Appl. No.: 290,236

[22] Filed: Aug. 5, 1981

[51] Int. Cl.[3] ..... A63B 3/00

[52] U.S. Cl. ..... 272/63; 211/182; 248/165

[58] Field of Search ..... 272/62, 63; 248/165, 248/166; 211/119.01, 123, 182, 191, 204, 206, 17, 27; 5/127, 130

[56] References Cited

U.S. PATENT DOCUMENTS

| | | | |
|---|---|---|---|
| 795,152 | 7/1905 | Montgomery | 211/27 |
| 871,692 | 11/1907 | Gray | 5/127 X |
| 2,071,132 | 2/1937 | Loucks | 211/204 X |
| 2,490,858 | 12/1949 | Deddo | 248/165 |
| 2,675,981 | 4/1954 | Ferris | 248/166 |
| 2,690,789 | 10/1954 | Zadrozny | 272/63 X |

FOREIGN PATENT DOCUMENTS

| | | | |
|---|---|---|---|
| 336522 | 3/1904 | France | 272/63 |

*Primary Examiner*—Robert A. Hafer
*Assistant Examiner*—Arnold W. Kramer
*Attorney, Agent, or Firm*—Vernon D. Beehler

[57] ABSTRACT

A set of light-weight demountable parallel gymnastic bars makes use of tubular metal material built up as two identical end sections and two identical bar assemblies. Each end section provides a pair of braced laterally extending feet, a pair of endwardly extending feet and a pair of stationary posts. Each bar assembly provides one bar on which are anchored two extension posts adapted to releasably and telescopingly engage respective stationary posts when the set is assembled for use.

8 Claims, 6 Drawing Figures

PORTABLE KNOCK-DOWN PARALLEL BAR EXERCISE FIXTURE

Parallel bars for gymnastic work, and especially competitive gymnastics, have consistently been built with an integral base presenting four corner posts, the posts being in pairs at opposite ends of the elongated base for reception of opposite ends of the parallel bars. The bars have customarily been made of polished wood, the base being made of metal.

As can be readily appreciated, when parallel bars are used by gymnastic specialists in which they must support the body in a wide variety of attitudes, such equipment must have an extremely stable and dependable structure. Heretofore this has invariably been accomplished by not only having the footings for the base extend laterally outwardly an appreciable distance, but also by making use of an extremely heavy base. Official parallel bars meeting current specifications for competition weigh as much as 480 pounds per set and at current prices retail between $1800 and $2000 per set.

It is also true that traditionally gymnastic exercises as, for example, those performed on parallel bars almost invariably are partaken of indoors in a conventional gymnasium. Accordingly, parallel bars for such gymnastic exercises, although being equipped to be readily handled over a polished hardwood floor are not such that they can be set up out of doors. Further still, the very character of conventional parallel bars constructed partially of wood and for the remainder mostly of ferrous metals are such that they would weather very poorly if not kept indoors for use and storage. Furthermore, it must always be true that such parallel bars be made subject to a degree of vertical adjustment so that the two bars of the pair may at some times be in the same horizontal plane parallel to each other and at other times while still parallel be such that one bar is mounted appreciably lower than the other. Both bars, of course, need to be subject to vertical adjustment.

Because of the integrated character of the base of the official parallel bar, there is no attention given to collapsibility for storage or transportation purposes. Accordingly, the equipment once set up must be moved in its entirety from one space to another and there is no such thing as compact storage when not in use.

Although some attempt has been made to make available parallel bars of more modest standards such as can be used by juniors, there cannot even in such equipment be a sacrifice with respect to stability and reliability. Inasmuch as such items of equipment for junior use still make use of an integrated base or base frame upon which the parallel bars are adjustably mounted, such junior, and less costly equipment, is still bulky to shift about and to store when not in use. Even though such equipment is to a degree lighter in weight, it is still too expensive for the average householder to procure and set up for the use of junior gymnasts, not only for want of sufficient space for both use and storage, but also because of price and the need for setting such equipment up indoors.

Limitations in the equipment and manner of use is accordingly detrimental to the health of gymnastics as a sport. Fewer juniors are able to participate because of not having access to a gymnasium where such equipment is available and also because such equipment is too costly for use at home and out-of-doors.

It is therefore among the objects of the invention to provide a new and improved portable, knock-down parallel bar exercise fixture which is relatively light in weight as a result of efficient use of metal parts but which at the same time is stable under substantially all conditions.

Another object of the invention is to provide a new and improved portable knock-down parallel bar exercise fixture which, because of its construction and the selection of materials, is not only relatively light in weight but also relatively inexpensive so as to be well within reach of many persons for whom the cost of official parallel bar fixtures is prohibitively high.

Still another object of the invention is to provide a new and improved portable knock-down parallel bar exercise fixture which not only is dependably stable but is also light in weight, relatively inexpensive, and of such character that it can be used either outdoors or indoors without material deterioration.

Still another object of the invention is to provide a new and improved portable knock-down parallel bar exercise fixture which can be quickly separated one part from another and packed in a compact arrangement for storage but which also is of construction such that persons of no more than average ability can quickly and dependably interconnect the several parts of the device and make the fixture ready for immediate use.

Still another object of the invention is to provide a new and improved portable knock-down parallel bar exercise fixture of a structure such that bar assemblies, once assembled with the ground engaging portions, interreact in a fashion producing a very stable assembled fixture without need to make use of heavy weights to assure stability.

Still further among the objects of the invention is to provide a new and improved relatively simple and inexpensive parallel bar exercise fixture which can be used as readily out-of-doors as indoors without material prospect of deterioration.

With these and other objects in view, the invention consists of the construction, arrangements, and combination of the various parts of the device serving as an example only of one or more embodiments of the invention, whereby the objects contemplated are attained, as hereinafter disclosed in the specification and drawings, and pointed out in the appended claims.

Figures 1, 2, 3, 4, 5, 6:
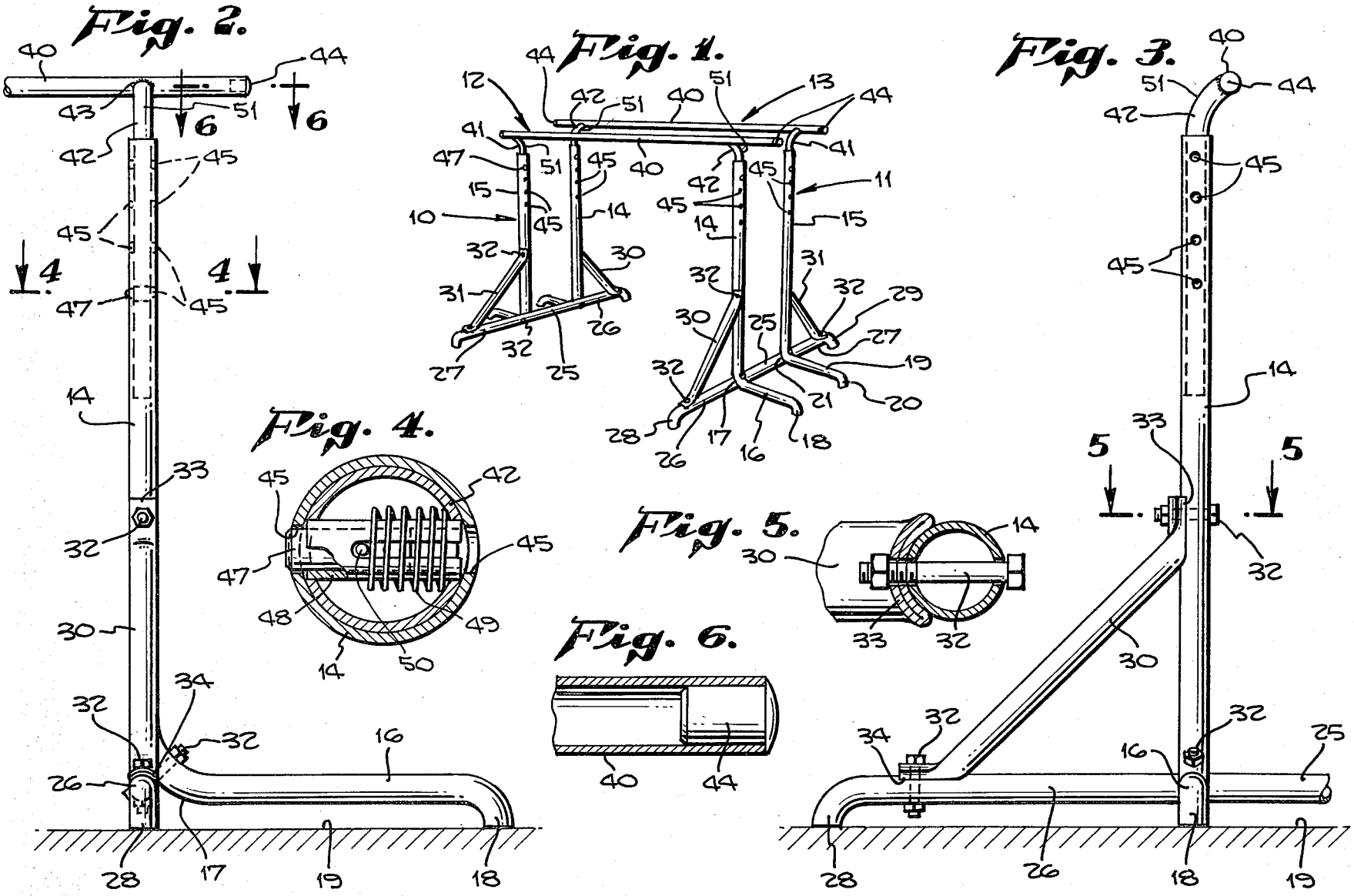
FIG. 1 is a side perspective view of the portable gymnastic parallel bars in assembled condition ready for use.
FIG. 2 is a fragmentary side elevational view of the bars taken at one end of the assembly.
FIG. 3 is a fragmentary end elevational view of one side of the assembly.
FIG. 4 is a cross-sectional view on the line 4—4 of FIG. 2.
FIG. 5 is a cross-sectional view on the line 5—5 of FIG. 3.
FIG. 6 is a fragmentary cross-sectional view taken on the line 6—6 of FIG. 2.

In an embodiment of the invention chosen for the purpose of illustration, just one form of gymnastic parallel bar set has been shown consisting in the main of a first end assembly 10, a second identical end assembly 11, and two identical bar assemblies 12 and 13.

Each end assembly consists of two tubular stationary posts 14 and 15 firmly held in vertical position. The post 14, by way of example, has an endwardly disposed tubular section 16, integral with the stationary post 14, there being a right angularly bent corner section 17 joining the two together. At the outermost end of the endwardly disposed tubular section is a downwardly bent toe member 18, the purpose of which is to engage an appropriate supporting surface 19.

The stationary post 15 is similarly equipped with an endwardly disposed tubular section 19 terminating in a toe member 20, there being a corner section 21, similar to the corner section 17, interconnecting the stationary post with the endwardly disposed tubular section.

Interconnecting the tubular posts and their respective endwardly disposed sections is a single tubular transverse beam 25. The transverse beam spans the distance between the stationary posts 14 and 15 and is of such length that there is a tubular laterally disposed section 26 extending beyond the stationary post 14 and a tubular laterally disposed section 27 extending beyond the stationary post 14, the laterally disposed sections 26 and 27 terminating in respective toe members 28 and 29. To provide adequate bracing there is a tubular diagonal brace 30 extending between the stationary post 14 and the laterally disposed section 26. A similar tubular diagonal brace 31 extends between the stationary post 15 and the laterally disposed section 27.

For releasably attaching together the various parts of each of the end assemblies, six bolts 32 are provided. One bolt attaches the corner section 17 to the transverse beam 25. Another bolt 32 attaches the corner section 21 to the transverse beam 25. There is a bolt 32 for each lower end of the respective diagonal braces 30 and 31 attaching them to respective laterally disposed sections 26 and 27. Of the remaining two bolts 32, one releasably attaches the upper end of the diagonal brace 30 to the stationary post 14 and the other releasably attaches the upper end of the diagonal brace 31 to the stationary post 15. The parts as described, bolted together as noted, comprise the end assembly 11. The end assembly 10, merely reversed in position left to right and right to left, is identically constructed and identically fastened together, the end assemblies 10 and 11 being interchangeable.

For added rigidity the diagonal brace 30 at its upper end has a flattened area 33 bent in an arcuate shape to conform with the outside circumference of the vertical post 14. There is a similar flattened area 34 at the lower end of the diagonal brace 30 which is given a curved form to correspond with the outside circumference of the laterally disposed tubular section 26. The diagonal brace 31 is similarly constructed and formed.

The bar assembly 12, by way of example, consists of an elongated tubular bar 40 provided with identical tubular extension posts 41 and 42. In practice, and for a bar 40 with an overall length of about eight feet, it has been found advantageous to locate the extension posts 41 and 42 eleven or twelve inches inwardly from the respective ends of the bar. Because the extension posts are part of the structure relied upon to provide rigidity and stability for the parallel bar set when in assembled condition, a welded joint 43 is made use of to attach the extension post to the bar throughout the entire circumference of the upper end of the extension post. Furthermore, to provide a finished appearance, there is a plug 44 inserted into each end of the bar 40 where it may be retained by a friction fit.

In the interest of providing adjustability, longitudinally spaced holes 45 extend through the stationary corner posts 14 and 15 in each instance, there being provided in the respective extension posts 41 and 42, as the case may be, a hole for reception of a sleeve 48 in which is an adjusting pin 47. A spring 49 bottoming against the interior wall of the extension post 42 is biased outwardly against a keeper 50 in the pin 47 thereby to urge the pin 47 into the appropriate hole 45.

The bar assembly 13 is identical to the bar assembly 12 in being provided with the elongated tubular bar 40 and identical tubular extension posts 41 and 42.

For some understanding of the proportions of the parallel bar set, although not precisely critical, it has been found advantageous to construct the stationary posts of tubular metal $1\frac{7}{8}$ inches in diameter and to make use of extension posts $1\frac{5}{8}$ inches in diameter so as to telescope smoothly and snugly within the stationary posts. On occasions, however, it may be found more advantageous to reverse the telescoping arrangement.

A device of suitable proportions, moreover, is one wherein the stationary posts are about four feet high, accommodating extension posts about two feet long. Sufficient stability is achieved when the endwardly disposed sections and the laterally disposed sections are something over two feet long, the spacing between stationary posts at each of the end assemblies being about twenty inches. Further still, for uniformity and economy of construction, an elongated tubular bar 40 can be one of the same outside diameter as the tubular extension posts. All elements of the end assembly may preferably be constructed of tubular members of the same $1\frac{7}{8}$ inch diameter. Where, as may frequently occur, the parallel bar set is to be used out of doors, the toe members should be such as to elevate the transverse beam 25 and also the endwardly disposed sections 16 and 19 and laterally disposed sections 26 and 27 and $1\frac{1}{2}$ inches above the supporting surface.

In assembling the parallel bar set for use, all that is required is to place the end assemblies 10 and 11 on the supporting surface about six feet apart and then project first the extension posts 41 and 42 of one of the tubular bars 40 into the corresponding stationary posts 14 and 15. The other stationary posts 14 and 15 of the respective end assemblies can then be more readily precisely positioned for reception of the extension posts 41 and 42 of the other elongated bar 40. After the extension posts have been inserted, they can be lifted to the desired level and the adjusting pins projected through the appropriate holes 45 to hold them at that level. Clearly the elongated tubular bars 40 may be adjusted to the same level or, if preferred, adjusted to different levels.

For changing the spacing between the tubular bars 40 the upper end of each extension post has a bent section 51 for displacing the centerline of the bar laterally relative to the centerline of the extension post. The displaced distance may conveniently be about $\frac{3}{4}''$. On this premise, when the bent portions are directed outwardly for both bar assemblies the distance between the bars will be three inches wider than when both have the bent portions directed inwardly. By directing bent portions of one bar assembly outwardly and the other inwardly the bar spacing will be at an intermediate distance.

When the parallel bar set is to be disassemblied, it is necessary to no more than depress the adjusting pins out of engagement with the vertical posts, withdraw the extension posts, and then stack end assemblies one upon the other and bar assemblies likewise in a snugly adjacent position. The entire parallel bar set when disassembled and stacked occupies no more width than a single end assembly with the bar assemblies taking up little more room lengthwise than the overall lateral width of the end assemblies. Further, by reason of the fact that all structural parts are tubular and moreover uniformly tubular, the entire parallel bar set is one relatively light in weight, but without sacrifice in stability during use. Obviously if only a single bar 40 is needed for a gymnastic exercise one of the bar assemblies 12 or 13 can be entirely removed.

In the alternative end assemblies 10 and 11 can be built each with a single vertical post wherein both diagonal braces 30 and 31 would be attached to the same vertical post.

While particular embodiments of the present invention have been shown and described, it will be obvious to those skilled in the art that changes and modifications may be made without departing from the invention in its broader aspects and, therefore, the aims of its appended claims are to cover all such changes and modifications as fall within the true spirit and scope of this invention.

Having described the invention, what is claimed as new in support of Letters Patent is as follows:

1. A relatively lightweight demountable gymnastic bar set for mounting on a horizontal supporting surface, said bar set comprising two identical end assemblies and at least one bar assembly, each end assembly comprising three tubular elements forming respectively a vertically disposed tubular stationary post, a tubular transverse beam having at each end a laterally outwardly disposed section extending beyond the respective post and a diagonal bracing between the stationary post and the beam, the stationary post having a tubular section extending when in assembled condition transversely endwardly of said bar set, said bar assembly comprising an elongated tubular bar, a pair of identical tubular extension posts of the bar rigidly anchored to the bar at locations adjacent respective ends of the bar and in right angular relationship to the bar, each extension post being adapted to telescopingly engage a respective one of said stationary posts when the bar set is in assembled condition for use.

2. A relatively lightweight demountable gymnastic bar set as in claim 1 wherein there are two bar assemblies and wherein there are two stationary posts and diagonal bracing making a maximum of five tubular elements for each end assembly, each extension post of the bar assembly being engageable with a respective one of said stationary posts in assembled condition for use.

3. A relatively lightweight demountable gymnastic bar set as in claim 2 wherein the endwardly disposed tubular end section in each instance is an extension of the respective stationary post and there is an arcuate right angular junction of the same material between the stationary post and its respective end section.

4. A relatively lightweight demountable gymnastic bar set as in claim 3 wherein there is a releasable connection between the arcuate right angular junction and the tubular transverse beam.

5. A relatively lightweight demountable gymnastic bar set as in claim 2 wherein there is a downwardly bent support engaging toe member at the outer end of each said section comprising an integral portion of tubular material of the respective section adapted to elevate said parallel bar set above the supporting surface.

6. A relatively lightweight demountable gymnastic bar set as in claim 2 wherein each extension post is extendible to different positions of elevation relative to the respective stationary post, and releasable locking means between the respective stationary and extension posts operable at a plurality of different positions of elevation.

7. A relatively lightweight demountable gymnastic bar set as in claim 2 wherein the diagonal bracing comprises in each instance a tubular section and a maximum of three bolts to fasten together the stationary post, the outwardly and endwardly extending tubular sections and the tubular beam at each corner of the set.

8. A relatively lightweight demountable gymnastic bar set as in claim 2 wherein the bar assemblies are identical and each extension post has an arcuate portion adjacent the end which is anchored to the bar whereby the centerline of the bar is offset laterally relative to the centerline of the extension post so that the distance between said bars can be selectively varied by alternating orientation of the arcuate portions of said extension posts to reverse position on the end assemblies.

* * * * *